US005993324A

United States Patent [19]

Gammil

[11] Patent Number: 5,993,324

[45] Date of Patent: Nov. 30, 1999

[54] FRAME DESIGN GOLF PUTTER HEAD

[76] Inventor: Alex R Gammil, 13458 Gent Dr., Austin, Tex. 78729

[21] Appl. No.: 09/105,569

[22] Filed: Jun. 27, 1998

[51] Int. Cl.[6] ..... A63B 53/06; A63B 69/36

[52] U.S. Cl. ..... 473/251; 473/313; 473/340; 473/334

[58] Field of Search ..... 473/324–350, 473/251–255, 219, 287–293, 256, 313; D21/736–746

[56] References Cited

U.S. PATENT DOCUMENTS

| | | |
|---|---|---|
| D. 231,373 | 4/1974 | Pavelle . |
| D. 339,181 | 9/1993 | Grim . |
| D. 354,104 | 1/1995 | Hardy . |
| 2,222,534 | 12/1940 | Harris . |
| 3,042,405 | 7/1962 | Solheim . |
| 3,873,094 | 3/1975 | Sebo et al. . |
| 3,888,492 | 6/1975 | Cabot . |
| 4,010,958 | 3/1977 | Long . |
| 4,121,832 | 10/1978 | Ebbing . |
| 4,253,667 | 3/1981 | Clark et al. . |
| 4,754,976 | 7/1988 | Pelz . |
| 4,871,174 | 10/1989 | Kobayashi . |
| 5,080,365 | 1/1992 | Winchell . |
| 5,275,412 | 1/1994 | Innes . |
| 5,308,069 | 5/1994 | Paquette . |
| 5,409,219 | 4/1995 | Saksun . |
| 5,429,356 | 7/1995 | Dingle et al. . |
| 5,470,070 | 11/1995 | Bendo . |
| 5,529,302 | 6/1996 | Rodriquez . |
| 5,580,058 | 12/1996 | Coughlin . |
| 5,628,694 | 5/1997 | O'Connor . |

*Primary Examiner*—Sebastiano Passaniti

*Attorney, Agent, or Firm*—Shinjyu Global IP Counselors, LLP

[57] ABSTRACT

A golf putter head design comprising multiple lateral plates (20) sandwiching multiple longitudinal rods (22, 24) to form a frame design (18) similar to the roman numerals II and III where the vertical gaps (26) in the putter head have a plan view width not to exceed the doubling of the plan view width of the thickest rod (22, 24). The present frame design (18) takes advantage of: embodied and relational (26) sight lines; a center sight line having a significant plan view width; peripheral rods (24) that are greater in density than the rest of the putter head; an option for a pivotable shaft; an option for interchangeable plates (20); and, an option for interchangeable rods (22, 24).

16 Claims, 4 Drawing Sheets

FRAME DESIGN GOLF PUTTER HEAD

BACKGROUND

1. Field of the Invention

This invention relates to golf putter heads, specifically a frame design that improves alignment and performance, and facilitates customization.

2. Description of the Prior Art

The putter is the most important club for a golfer. On average, the putter accounts for 40 percent of score, twice as much as the second most often used club, the driver. Most putter heads are manufactured with a rigid appearance, percussion, balance, length, width, height, loft, lie, and weight, so the golfer must learn to conform to the putter. There is a need for a putter that conforms to the golfer, a putter that can be customized to fit the golfer's preferences.

In Golf Magazine's, May 1995 issue, in the article "How to Pick a Putter," pages 100–101, David T. Pelz lists the most important attributes in choosing a putter—in order by most important: 1) shaft length (not relevant to putter head design), 2) shaft angle [lie], 3) balance [peripheral weighting], 4) alignment aides, 5) weight, 6) grip (not relevant to putter head design), 7) head-twisting at impact [torc], 8) repetitive soling (returns to the same position when soled), 9) appearance, and 10) feel [percussion].

There are numerous putter head patents that disclose adjustability for lie, alignment, weight, torc, appearance, percussion, and loft (not listed above), but these patents usually address only one attribute per patent, and even fewer solve three or more attributes in one design. U.S. Pat. No. 5,429,356 to Craig B. Dingle and William Harpell (1995) discloses an adjustable putter head where lie, weight, and torc are adjustable. But, the putter's main element remains the same, preventing changes in appearance and not allowing for customization of peripheral weighting, alignment aides, repetitive soling, percussion, and loft. There is still a need for a putter head that will allow customization for all attributes in one design, giving the golfer absolute control of the putter's arrangement.

Golf is a game of accuracy and repeatability of which alignment plays a very significant part. When golfers use the standard alignment aids on putter heads, many tend to aim to the right or left of the target. When the golfer performs the putting stroke, their brain makes a subconscious correction by either opening or closing the striking face at impact. As the golfer nears the target, less correction is used; but, in essence, the golfer has a slightly different putting stroke for every distance.

All putter heads have some type of alignment aid. The most common is perpendicular squaring, when an elongated-embodied element extends perpendicular to the longitudinal axis of the putter head, analogous to lining up a tennis ball with a racket. Of those, most use singular squaring, having only one embodied element. U.S. Pat. No. 2,222,534 to Howard T. Harris (1940) discloses a putter with two plates. Multiple elements are easier to align than one element because the brain can use multiple reference points for aligning the putter head. Even with multiple elements, perpendicular squaring is not as easy to align as parallel squaring, when an elongated-embodied element extends parallel to the longitudinal axis of the putter head, analogous to lining up a billiard ball with a cue. U.S. Pat. No. 5,529,302 to Moctezuma Rodriguez (1996) discloses a putter head that uses one slender-elongated rod for parallel squaring. The single rod has the benefit of creating a free-standing embodied sight line which is also easier to align than painted lines on a thick element because the golfer can see the turf beside the element and decide how the element should travel over the turf, creating a relational effect. Even though singular parallel squaring improves alignment, it usually fails to provide peripheral weighting, when a putter's toe and heel weigh more than its center. U.S. Pat. No. 4,754,976 to David T. Pelz (1988) discloses a putter head that improves peripheral weighting by using a thick-elongated rectangle. The rectangle is also capped by a plate but the plate is rendered nonexistent by the rectangle's thickness which is thicker than the golf ball and the central focus area. The thickness weakens the embodied sight line and parallel squaring. This is an example where improving peripheral weighting inevitably weakened parallel squaring, creating an ostensibly inverse relationship between the two. U.S. Pat. No. 3,873,094 to Alexander Sebo and Leroy H. Despins (1975) discloses multiple parallel squaring elements using three elongated cylinders in a transparent plate. Since longer elements are easier to align than shorter elements, the relatively short length of the cylinders, and the position of the hosel between cylinders, weakens parallel squaring. Additional embodiments of this patent use webs or bridges to connect the short cylinders which further impedes the embodied sight line and weakens parallel squaring.

The next step in the progression is putters that have at least one perpendicular and one parallel squaring element in one design. U.S. Pat. No. 5,080,365 to Frank J. Winchell (1992) discloses a putter head that uses an elongated rod as the parallel squaring element and an elongated plate as the perpendicular squaring element. The putter head has a plan view silhouette resembling the letter 'T'. This design suffers from the ostensibly inverse relationship between peripheral weighting and parallel squaring. Additional embodiments of this patent address peripheral weighting by changing the shape of the rod into a triangular framework with weighted-knobs at each comer. The change inevitably weakens parallel squaring because it creates non-linear plan view interference from protuberances, cavities, and transversing elements. U.S. Pat. No. 5,470,070 to Christopher J. Bendo (1995) discloses another putter in the shape of a 'T' where the ends of the perpendicular squaring element terminate into nodules. The majority of the putter is still located in the parallel squaring element. The sinuous body weakens perpendicular and parallel squaring. Again, improving peripheral weighting inevitably weakened parallel squaring. U.S. Pat. No. 5,580,058 to Brian E. Coughlin (1996) discloses a putter head with one elongated plate for perpendicular squaring and two elongated rods at the peripheries for parallel squaring. The putter head's main objective is to place the rods out of the central focus area, weakening parallel squaring. Again, improving peripheral weighting inevitably weakened parallel squaring. U.S. Pat. No. 4,253,667 to Jack L. Clark and William T. Naud (1981) discloses a putter head with an elongated rectangular midsection with extending webs that give the putter head a plan view silhouette resembling the letter 'H'. This design also suffers from the ostensibly inverse relationship between peripheral weighting and parallel squaring. Its midsection is too thick to be effective for parallel squaring. U.S. Pat. No. 5,275,412 to Stuart W. Innes (1994) discloses a putter head with long front and sole plates and a short back plate. Three tiny rungs bridge the front plate with the back plate to create multiple parallel squaring elements. The tiny size of the rungs weakens the embodied sight lines, and the position of the sole plate beneath the rungs eliminates the relational effect of a free-standing embodied sight line. U.S. Pat. No. 5,628,694 to O'Connor, Jr. (1997) discloses a practice putter head with a plan view silhouette in the shape of a hollow rectangular-oval. Inside the hollow are three tiny rungs used for longitudinal alignment on a rug painted with three corresponding lines. The tiny size of the rungs, combined with deltoid ends, and the position of the rungs near the bottom of the deep rectangular-oval, weakens parallel squaring.

Frame putters provide both multiple perpendicular and parallel squaring elements in one design. U.S. Pat. No. 4,010,958 to Steve K. Long (1977) discloses a frame putter head where multiple rods are parallel, perpendicular and angled to the longitudinal axis of the putter head. The putter's primary feature, weighted square knobs at the comers of a square frame, combined with angled and sinuous internal rods, creates interference that weakens both parallel and perpendicular squaring. The center rod is too thin and sinuous, and the gaps between the longitudinal rods, though prototypical of peripheral weighting, are much too large—over twice the width of the longitudinal rods—to be effective for parallel squaring. The lack of a center rod in additional embodiments further widens the gap between rods. Design Pat. No. 231,373 to Richard Pavelle (1974) discloses a frame putter with five plates. Two lateral plates are used as perpendicular squaring elements, and three longitudinal plates are used as parallel squaring elements. The center longitudinal plate is too thin, and the gaps between the longitudinal plates, though prototypical of peripheral weighting, are much too large—over twice the width of the longitudinal plates—to be effective for parallel squaring. The smooth connections between the plates, and the lack of extending webs, obscures the borders between lateral and longitudinal plates which weakens perpendicular and parallel squaring. This design doesn't provide optimal peripheral weighting since the plates are composed of the same material throughout.

There is still a need for a putter head that optimizes alignment without sacrificing performance, a putter that can help the golfer setup correctly. Incidentally, of the twelve putters listed for alignment illustrations, one (U.S. Pat. No. 2,222,534) provides lie adjustability, three (U.S. Pat. Nos. 5,529,302, 5,080,365, and 4,253,667) provide weight adjustability, and one (U.S. Pat. No. 5,275,412) provides peripheral weighting, weight, and torc adjustability. None provide customization for appearance, alignment aides, repetitive soling, percussion, and loft.

OBJECTS AND ADVANTAGES

Several objects and advantages of the present invention are:

a) to provide a putter head which optimizes alignment without sacrificing performance;

b) to provide a putter head which optimizes sight lines;

c) to provide a putter head which allows customization for lie, peripheral weighting, alignment aides, weight, torc, repetitive soling, appearance, percussion, and loft; and, d) to provide an adjustable putter head which is simple to operate.

Additional objects and advantages will become apparent from a consideration of the drawings and ensuing descriptions.

| Reference of Numerals | | |
|---|---|---|
| 18 frame design | 20 plate | 22 center rod |
| 24 peripheral rod | 26 gap/relational sight line | 28 longitudinal axis |
| 30 hosel | 32 screw | 34 hole |
| 36 peripheral rod end | 38 pocket | 40 insert |
| 42 center rod end | 44 sole | |

SUMMARY OF THE INVENTION

A golf putter head comprising multiple rectilinear longitudinal elements sandwiched by multiple lateral elements, where the gaps between the longitudinal elements do not exceed the doubling of the plan view width of the thickest longitudinal element, that will:

(1) improve alignment by using a center sight line of significant size;

(2) optimize alignment by using embodied and relational sight lines;

(3) improve performance by using peripheral longitudinal elements that are significantly greater in density than the rest of the putter head; and, (4) optimize customization by using lateral and longitudinal elements that are removable, adjustable or interchangeable.

Description—FIGS. 1 to 11

Figure 1A:
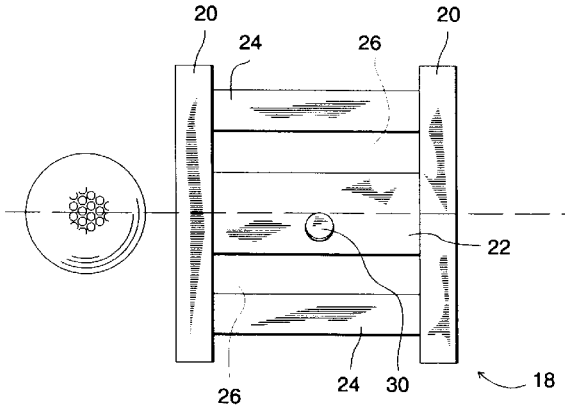
FIGS. 1A and 1B show plan views of typical embodiments of the present invention.
Figure 2:
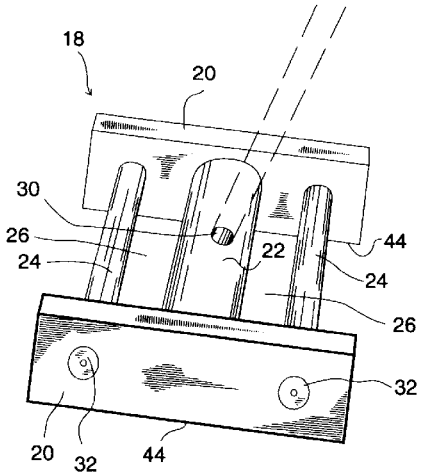
FIG. 2 shows a perspective view of FIG. 1A.

A typical embodiment of the present frame design 18 is illustrated in FIG. 1A and FIG. 2. The putter head has two elongated rectangular plates 20 that sandwich three elongated rods 22, 24. Together, the plates 20 and rods 22, 24 form a plan view silhouette of the roman numeral "III."The plates 20 are planar in shape, 90 mm long, 10 mm thick and 25 mm high. The rods 22, 24 are 65 mm long, parallel to each other, and perpendicular to the plates 20. The center rod 22 has a diameter of 19 mm and is placed in the middle of the central focus area the area inside a 22.5 mm imaginary cylinder radius (slightly larger than a golf ball) located around the longitudinal axis 28 of the putter head. Peripheral rods 24 have a diameter of 12 mm, are made from material heavier than the rest of the putter head, and are positioned 15 mm on each side of the center rod 22 so as to leave vertical gaps 26 in the putter head. The shaft enters a hosel 30 in the symmetrical center of the center rod 22.

Figure 1B:
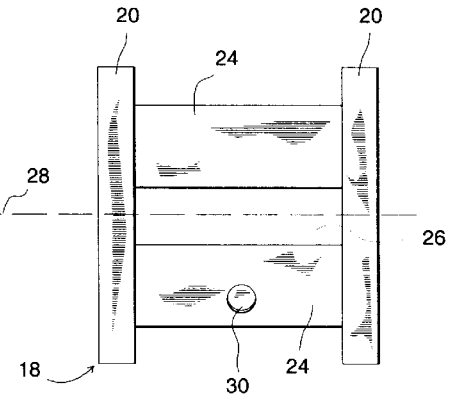
Figure 9:
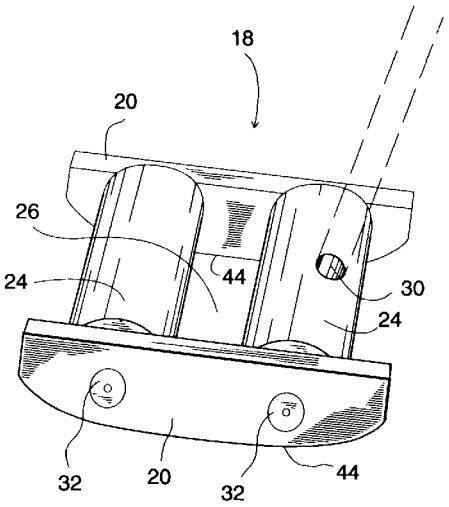
FIG. 9 shows a perspective view of FIG. 1B.

Another typical embodiment of the present frame design 18 is illustrated in FIG. 1B and FIG. 9. The putter head has two elongated rectangular plates 20 that sandwich two elongated rods 24. Together, the plates 20 and rods 24 form a plan view silhouette of the roman numeral "II." The plates 20 are planar in shape, 90 mm long, 10 mm thick and 25 mm high. The rods 24 are 65 mm long, parallel to each other, and perpendicular to the plates 20. The rods 24 have a diameter of 12 mm, are made from material heavier than the rest of the putter head, and are positioned 20 mm apart so as to leave a vertical gap 26 in the putter head. The shaft enters a hosel 30 in the symmetrical center of one of the rods 24.

Figure 3:
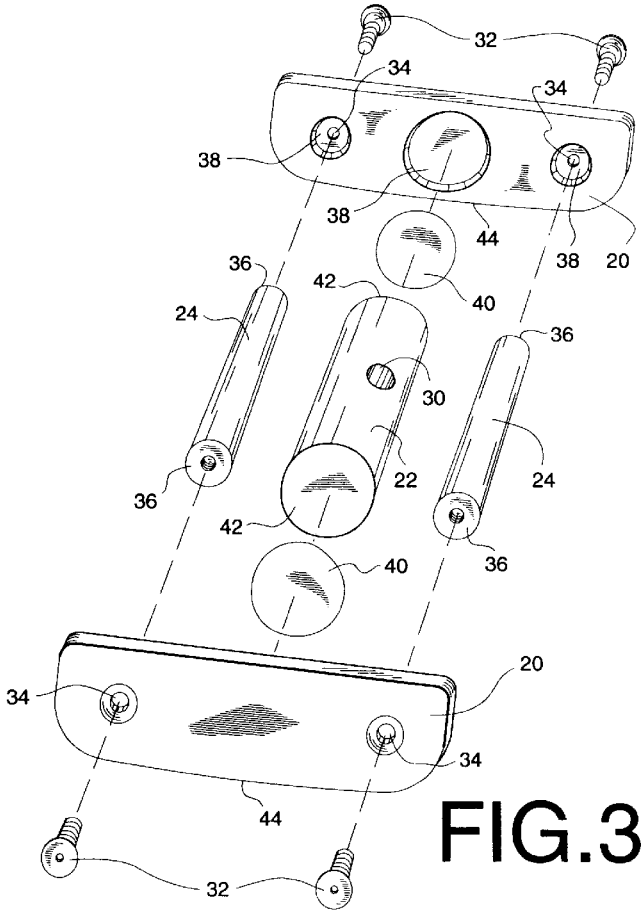
FIG. 3 shows an exploded view of a typical embodiment of the present invention.
Figure 4:
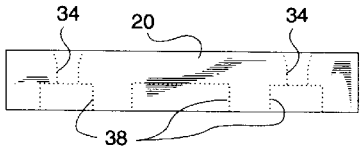
FIG. 4 shows a plan view of a typical plate.
Figure 5A:
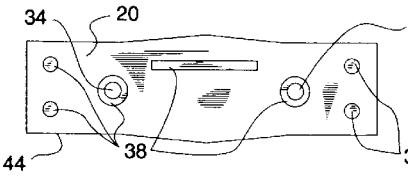
FIGS. 5A to 5E show back elevational views of typical plates.
Figure 5B:
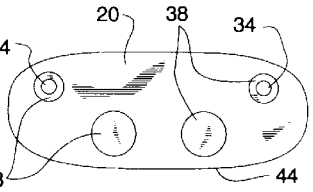
Figure 5C:
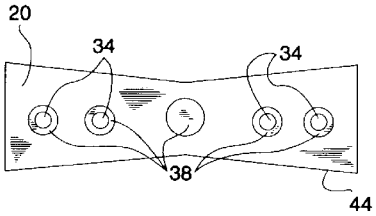
Figure 5D:
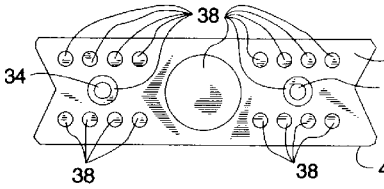
Figure 5E:
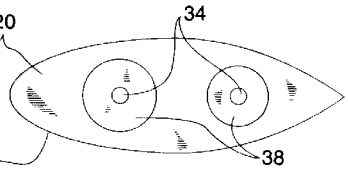
Figure 6A:
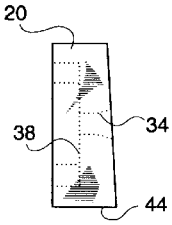
FIGS. 6A to 6D show side elevational views of typical plates.
Figure 6B:
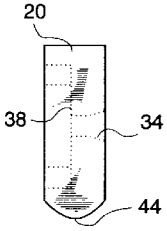
Figure 6C:
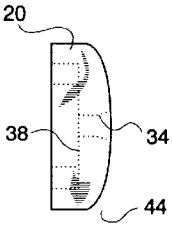
Figure 6D:
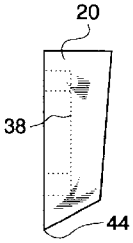

FIG. 3 is an exploded isometric view of the present frame design 18. The whole unit is fastened together with screws 32 that fit through holes 34 in the plates 20 and fasten to each peripheral rod end 36. Plates 20 have pockets 38 for holding rod ends 36, 42. An optional insert 40, typically of rubber, between the center rod end 42 and the plate 20, will hold the center rod in place. Notches in the center pocket 38 will provide the same effect. The above description is merely one of the numerous embodiments possible with the present frame design 18. Additional plates 20 differ in composition, appearance, height, length, width, loft, and shape. In general, plates 20 have a rectilinear shape in the plan view, have a length greater than 45 mm, and have a plan view width greater than 5 mm. FIG. 4 shows the top view of a typical plate 20. The plate 20 is rectangular with three horizontally aligned pockets 20, two holes 34 and one large central pocket 38. FIGS. 5A to 5E show back views of typical plates 20. FIG. 5A shows a polygonal plate 20 with seven pockets 38: three horizontally aligned in the center, four vertically aligned on the peripheries. The large center pocket 38 is rectangular. The sole 44 converges down to the center. FIG. 5B shows an oval plate 20 with six pockets 38. The sole 44 is round. FIG. 5C shows a polygonal plate 20 with two peripheral pockets 38, one small center pocket 38 and four holes 34. The sole 44 converges up to the center. FIG. 5D shows a polygonal plate 20 with 19 pockets 38. FIG. 5E shows a wing shaped plate 20 with two disparately sized pockets 38. FIGS. 6A to 6D show side views of typical plates 20. FIG. 6A shows a plate 20 with a lofted face and a flat sole 44. FIG. 6B shows a plate 20 with no loft, and a round sole 44. FIG. 6C shows a plate 20 with a convex face. FIG. 6D shows a plate 20 with a hooded face and a tapered sole 44.

Figure 7A:
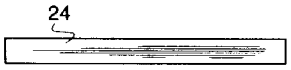
FIGS. 7A to 7I show side elevational views of typical rods.
Figure 7B:
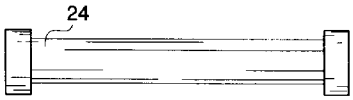
Figure 7C:
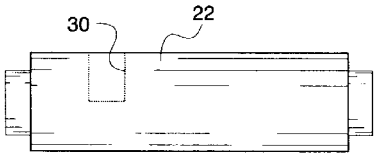
Figure 7D:
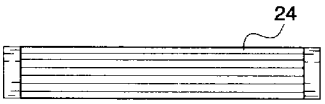
Figure 7E:
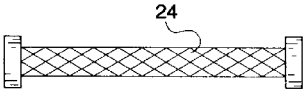
Figure 7F:
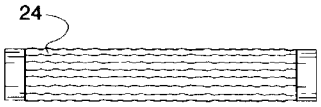
Figure 7G:
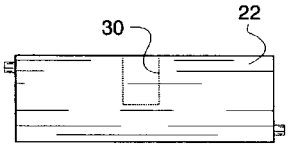
Figure 7H:
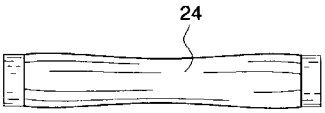
Figure 7I:
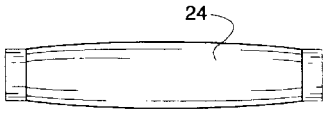
Figure 8A:
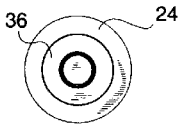
FIGS. 8A to 8C show front elevational views of typical rods.
Figure 8B:
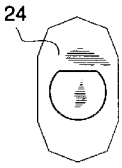
Figure 8C:
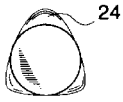

Additional rods 22, 24 differ in composition, appearance, length, width, shape, and weight. In general, rods 22, 24 have a length greater than 45 mm, and a plan view width greater than 5 mm. The center rod 22, when present, has a plan view width greater than the shaft's diameter but less than the ball's diameter, typically between 15 to 30 mm wide. Peripheral rods 24 are made from material heavier than the rest of the putter head. All rods 22, 24 are spaced so as to leave significant vertical gaps 26 in the putter head. The gaps 26 are rectilinear, devoid of non-linear interference, and—to optimize their effect—have a plan view width not to exceed the doubling of the plan view width of the thickest rod 22, 24. The limit can be calculated mathematically as $y=2x$, where x equals the plan view width of the thickest rod 22, 24 and y equals the maximum width of each vertical gap 26. By limiting the gaps 26 size, it ensures the creation of relational sight lines 26. FIGS. 7A to 7I show the side views of typical rods 22, 24. FIG. 7A shows a simple rod 24. FIG. 7B shows a narrow rod 24 with thicker ends. FIG. 7C shows a thick rod 24 with narrow ends, and a non-centered hosel 30. FIG. 7D shows a rod 24 with a multifaceted surface. FIG. 7E shows a rod 24 with an etched surface. FIG. 7F shows a rod 24 with a rough surface. FIG. 7G shows a rod 24 with notches on each end. FIG. 7H shows a rod 24 with a bulging center. FIG. 7I shows a rod 24 with bulging ends. FIGS. 8A to 8C show the front views of typical rods 22, 24. FIG. 8A shows a rod 24 that holds a screw. FIG. 8B shows a polygonal rod 24. FIG. 8C shows a triangular rod 24.

Figure 10:
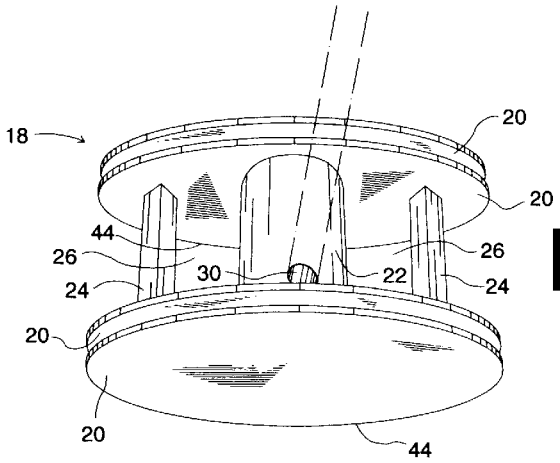
FIG. 10 shows a perspective view of an additional embodiment of the present invention.
Figure 11:
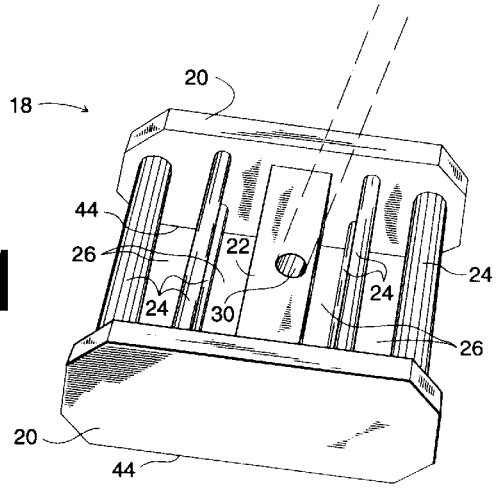
FIG. 11 shows a perspective view of an additional embodiment of the present invention.

As evidenced by the drawings, the combination of plates 20 and rods 22, 24 are many. FIG. 10 shows a frame design 18 with four plates 20, and three rods 24. The hosel 30 is near the front of the putter head. FIG. 11 shows a frame design 18 with two plates 20 and seven rods 24. The center rod 22 is flat.

From the description above, a number of advantages of the present frame design 18 become evident:

a) plates 20 and rods 22, 24 that are rectilinear in the plan view will produce a plane in shape frame design 18 where every element has a distinct border so that each element works for alignment which will directly optimize perpendicular and parallel squaring and directly improve stroke;

b) weighted peripheral rods 24 will directly improve performance without sacrificing alignment;

c) rods 22, 24 that are rectilinear in the plan view will create multiple embodied sight lines which will directly improve both alignment and stroke;

d) the enlarged center sight line, embodied or relational 26, will directly improve alignment;

e) the limited width of the vertical gaps 26 in the putter head will ensure the creation of relational sight lines 26, directly improving both alignment and stroke; and, f) the removable screws 32 will allow the plates 20 and rods 22, 24 to be interchanged with other plates 20 or rods 22, 24 which will allow absolute customization of the unit.

Operation

The manner of using the putter head to strike a ball is identical to that of other putters. The manner for customizing the putter head depends on the desired effect. Lie is adjusted by loosening screws 32, pivoting the shaft, and then retightening the screws 32. Notches in the center rod end 42 or inserts 40 will lock the shaft angle in place. Peripheral weighting is adjusted by interchanging plates 20 that have different locations for attaching peripheral rods 24. Alignment aides are adjusted by interchanging rods 22, 24 that have different widths, lengths and contrast, or by interchanging plates 20 that hold different amounts of rods 22, 24. Weight is adjusted by interchanging plates 20 or rods 22, 24 that have different weights. Torc is adjusted by interchanging rods 22, 24 that have different hosels 30, or by interchanging peripheral rods that have different weights. Repetitive soling is adjusted by interchanging plates 20 that have different sole 44 shapes. Appearance is changed by interchanging plates 20 or rods 22, 24 that have different shapes and colors. Percussion is adjusted by interchanging plates 20 that have different material compositions, or by interchanging inserts 40 to absorb impact vibrations. Finally, loft is adjusted by interchanging plates 20 that have different face angles or side view convexity.

From the operation described above, a number of advantages of the present frame design 18 become evident:

a) the removable screws 32 will provide easy assembly and disassembly of the unit;

b) adjustability for lie will help the golfer stand with good posture, directly improving stroke;

c) customization for peripheral weight and torc will allow the golfer to choose between having a larger sweet spot to reduce the effect of mishits, or having a smaller sweet spot so that mishits signal changes in stroke;

d) customization for weight adjustability will allow the golfer to increase the weight of the putter head for greens that are slow or reducing the weight for greens that are fast, so as to maintain the golfer's feel;

e) customization for repetitive soling will allow the golfer to choose between having a flat sole 44, to ensure a repeatable set up, or having a curved sole 44, to reduce turf snagging;

f) customization for appearance increases the golfer's likeability for the putter head, increasing the golfer's confidence;

g) customization for percussion will allow the golfer to choose between having a soft striking surface to transfer more energy to the ball, or having a hard striking surface to provide more feel;

h) customization for loft will allow the golfer to find a loft that works best for improving ball rolling, thus improving the golfer's feel; and, i) customization for alignment aides will allow the golfer to find a combination that works best for improving alignment needs. An interesting effect occurs when more rods 22, 24 are added. For each rod 22, 24 added, one would expect one sight line to be created. In actuality, there are two sight lines created, one embodied and one relational 26. This synergistic effect can be calculated mathematically as $y=2x-1$, where x equals the amount of rods 22, 24 used and y equals the total amount of sight lines created. The formula also shows there must be at least two rods 22, 24 for relational sight lines 26 to exist. Relational sight lines work best when they have a similar plan view width as the embodied sight lines.

Conclusions, Ramifications, and Scope

Previous attempts for providing multiple perpendicular and parallel squaring elements have suffered from an ostensibly inverse relationship between peripheral weighting and parallel squaring. When peripheral weighting was improved, parallel squaring was weakened, and vice versa. The present frame design optimizes both peripheral weighting and parallel squaring by significantly increasing the density of the peripheral elements and paradoxically increasing the width—not the weight—of the center element, or center sight line, to reduce the gap between the elements and produce powerful sight lines which optimize parallel squaring.

The present frame design also facilitates absolute customization. Unlike putter heads in the past where only a few attributes could be changed in one unit, the present frame design facilitates the customization of lie, peripheral weighting, alignment aides, weight, torc, repetitive soling, appearance, percussion, and loft. Though the present frame design provides absolute customization, it may be necessary to limit the extent of such customization so as to abide by the current rules of the United States Golf Association. Examples of such rules are: the putter head must be longer from head to toe than front to back; the loft cannot exceed ten degrees; a putter head can only have two striking surfaces and those must be identical; the putter head must be plane in shape; the shaft angle must exceed 10 degrees of vertical; etc. . . By providing a few interchangeable pieces and fettered adjustments, the putter head will prevent illegal combinations. Certain attributes could be deemed superior, thus eliminating the need for variations, or the rules could change, requiring additional variations.

While the descriptions above contains many specificities, these should not be construed as limiting the scope of the invention but as merely providing illustrations for the numerous embodiments that are feasible with the present frame design. In essence, the running theme between each possible embodiment is the use of two or more parallel elements joined at right angles with two or more parallel elements where the relational sight lines have a plan view width less than double the plan view width of the thickest longitudinal element to ensure the creation of the relational sight line.

I claim:

1. A golf putter head comprising:

at least two distinct elongated rods of predetermined thickness and length, said rods extending parallel to each other;

at least two elongated plates of predetermined thickness and length, said plates extending parallel to each other and perpendicular to said rods; and at least one fastening element fixedly coupling said rods between said plates, said rods being spaced non-contiguously at a width not exceeding twice the plan view width of the thickest of said rods, whereby a gap between said rods creates relational sight lines.

2. A golf putter in accordance with claim 1, wherein one of said rod members disposed closest to a midpoint of said plate members is wider and lesser in density than the other of said rod members disposed farther from said midpoint of said plate members.

3. A golf putter in accordance with claim 1, wherein said rod members are rectilinear in plan view and devoid of non-linear, plan-view interference.

4. A golf putter in accordance with claim 1, wherein said at least one fastening element detachably connects said plates and said rods to allow said rods and plates to be disassembled and reassembled.

5. A golf putter in accordance with claim 1, wherein said at least one fastening element rotatable connects said rods to said plates.

6. A golf putter in accordance with claim 1, wherein said plates have a planar surface so as to form a striking face.

7. A golf putter head comprising:

at least two distinct elongated rods of predetermined thickness and length, said rods extending parallel to each other one of said elongated rods being a hosel rod with a hosel adapted to receive a shaft therein;

at least two elongated plates of predetermined thickness and length, said plates extending parallel to each other and perpendicular to said rods; and a detachable connection member for detachably coupling said rods between said plates to allow said rods and plates to be disassembled and reassembled.

8. A golf putter head adapted to be coupled to a shaft, said golf putter comprising:

at least two plate members, said plate members being disposed laterally relative to one another; and at least two distinct rod members disposed between said plate members and coupled to said plate members, one of said rod members being a hosel rod with a hosel adapted to receive the shaft therein, said rod members being disposed substantially parallel to one another with a space therebetween, and the width of said space being no more than twice the width of the widest of said rod members.

9. A golf putter head as set forth in claim 8, wherein one of said rod members disposed closest to a midpoint of said plate members is wider than the other of said rod members disposed farther from said midpoint of said plate members.

10. A golf putter head as set forth in claim 8, wherein one of said rod members disposed closest to a midpoint of said plate members is lesser in density than the other of said rod members disposed farther from said midpoint of said plate members.

11. A golf putter head as set forth in claim 8, further comprising a connection member detachably coupling said rod members to said plate members.

12. A golf putter head as set forth in claim 8, wherein said hosel rod frictionally engages said plate members rotatably about a longitudinal axis of said hosel rod.

13. A golf putter head as set forth in claim 8, further comprising a friction member disposed between said hosel rod and said plate member.

14. A golf putter head as set forth in claim 13, wherein said friction member is made of resilient material.

15. A golf putter head as set forth in claim 13, wherein said friction member is made of rubber.

16. A golf putter head as set forth in claim 8, wherein said rod members are rectilinear, and said rod members are separated from one another when viewed from a direction toward which the shaft extends.

* * * * *